US007624669B2

(12) United States Patent
Paul

(10) Patent No.: US 7,624,669 B2
(45) Date of Patent: Dec. 1, 2009

(54) APPARATUS COMPRISING A PASSIVELY-ACTUATED SNUBBER

(75) Inventor: Buddy R. Paul, Perry Hall, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 471 days.

(21) Appl. No.: 11/120,419

(22) Filed: May 3, 2005

(65) Prior Publication Data

US 2009/0255398 A1 Oct. 15, 2009

(51) Int. Cl.
*F41F 3/04* (2006.01)

(52) U.S. Cl. ..... 89/1.817; 89/1.806; 89/1.819

(58) Field of Classification Search ..... 89/1.817, 89/1.8, 1.816, 1.819, 1.806
See application file for complete search history.

(56) References Cited

U.S. PATENT DOCUMENTS 2,960,009 A * 11/1960 Hereth et al. ..... 89/1.805
3,040,629 A 6/1962 Duncan et al.
3,228,297 A 1/1966 Kossan et al.
3,842,711 A 10/1974 Bodinaux
4,550,640 A * 11/1985 Harter ..... 89/1.806
4,750,404 A * 6/1988 Dale ..... 89/1.819
5,400,689 A 3/1995 Hütter et al.
5,533,433 A * 7/1996 Giesenberg et al. ..... 89/1.806
6,286,409 B1 * 9/2001 Na et al. ..... 89/1.806

FOREIGN PATENT DOCUMENTS

DE 733944 4/1943
GB 860606 2/1961

OTHER PUBLICATIONS

Vermander, W., "International Application No. PCT/US2006/016272 International Preliminary Report on Patentability Nov. 15, 2007", , Publisher: EPO, Published in: PCT.
Vermander, W., "International Application No. PCT/US2006/016272 International Search Report Sep. 4, 2006", , Publisher: EPO, Published in: PCT.

* cited by examiner

*Primary Examiner*—Michelle Clement
(74) *Attorney, Agent, or Firm*—DeMont & Breyer, LLC

(57) ABSTRACT

A passively-actuated apparatus for providing shock-absorption between a missile and a missile canister prior to missile launch, and for moving out of the path of a missile during missile launch. The apparatus comprises a snubber coupled to a passive actuator that drives a snubber from a position wherein the snubber is engaged with a missile to a position wherein the snubber is cleared from the path of any portion of the missile during launch. The actuator is purely mechanical in nature, and is passively-actuated by the motion of the missile itself as the missile begins launch.

18 Claims, 7 Drawing Sheets

APPARATUS COMPRISING A PASSIVELY-ACTUATED SNUBBER

The U.S. Government has a paid-up license in this invention and the right in limited circumstances to require the patent owner to license others on reasonable terms as provided for by the terms of Contract No. DASG60-00-C-0072.

FIELD OF THE INVENTION

The present invention relates to missilery in general, and, more particularly, to missile containment systems.

BACKGROUND OF THE INVENTION

Mobile missile-launcher platforms have become a mainstay of the military. A mobile missile launcher typically includes a vehicle, such as a truck or warship, and at least one missile, which is contained in a missile canister. The missile canister provides environmental protection for the missile, and contains some of the launcher infrastructure as well.

When the missile launcher is moved to or around a battlefield, a missile canister is subjected to shock and vibration, which could damage the missile it contains. Missile restraint and shock-absorption systems, therefore, are positioned between the missile and the missile canister to restrict longitudinal and lateral motion of the mounted missile. Called snubber systems, these systems include shock-absorbing missile mounts (i.e., snubbers) to dampen vibration that results from play between the missile canister and a missile. These snubber systems also include sensors and snubber controllers to help prevent unintended launch of the missile.

Snubbers should not interfere with egress of the missile from the canister during missile launch. In the prior art, therefore, snubbers systems include active systems such as controllers and actuators to retract the snubbers during launch.

Active snubber systems include sophisticated electronic or hydraulic systems to control or restrict snubber extension and retraction. Electronic systems include components such as solenoids, relays, control electronics, and snubber capacitors. Hydraulic systems include fluidic actuators, piping, hydraulic fluids or gasses, and valves.

The additional components associated with active snubber systems result in more weight, more complexity, reduced reliability, and higher system cost.

SUMMARY OF THE INVENTION

The present invention provides a passively-actuated apparatus that provides shock-absorption between a missile and a missile canister. In the illustrative embodiment, the apparatus includes a snubber coupled to a passive actuator that moves the snubber out of the way of the missile during missile launch. Unlike the prior art, and in accordance with the illustrative embodiment, the passive actuator is purely mechanical in nature and is actuated by the motion of the missile itself as the missile begins to launch.

In some embodiments, the missile loading process causes the snubber to rotate and engage with the missile. The missile loading process simultaneously compresses a spring in the actuator and latches it, thereby putting the actuator into a mechanically-bi-stable state. Once in its mechanically-bi-stable state, missile motion that is consistent with launch (i.e., above a threshold of motion) triggers the spring in the actuator to decompress, thereby driving the snubber to a cleared position wherein it does not impede egress of the missile from the missile canister.

DETAILED DESCRIPTION

The following terms are defined for use in this Specification, including the appended claims:

Mechanically-coupled means that one device is linked to another device such that movement of the one device affects the other device. For example, a motor and a mirror are mechanically-coupled if actuation of the motor causes motion of the mirror. This could be through direct contact, as in the case of two physically-coupled devices (e.g., a mirror that is mounted on a linear-motor); or through an intermediate medium (e.g., a mirror that is moved via a hydraulic force that is generated by a motor).

Physically-coupled means in direct, physical contact (e.g., a mirror that is mounted on a linear-motor).

Operatively-coupled means that the operation of one device affects another device, wherein the devices need not be physical coupled or even mechanically coupled. For example, a laser and a mirror are operatively coupled if a laser directs a beam of light to the mirror.

Mechanically-bi-stable state means a device state wherein the device is in a first stable position and will move to a second stable position in response to a mechanical stimulus (e.g., motion greater than a threshold). For example, a bicycle kick-stand is a mechanically-bi-stable device.

Passive actuator means an actuator that is triggered by an ancillary event or mechanism that is not, per se, a part of the passive release mechanism. An example of such an ancillary event is a change in state (e.g., position, velocity, orientation, etc.) of a member (ancillary member)

that is operatively-coupled to or otherwise affects a passive actuator, but that is not a part of that passive actuator.

Figure 1:
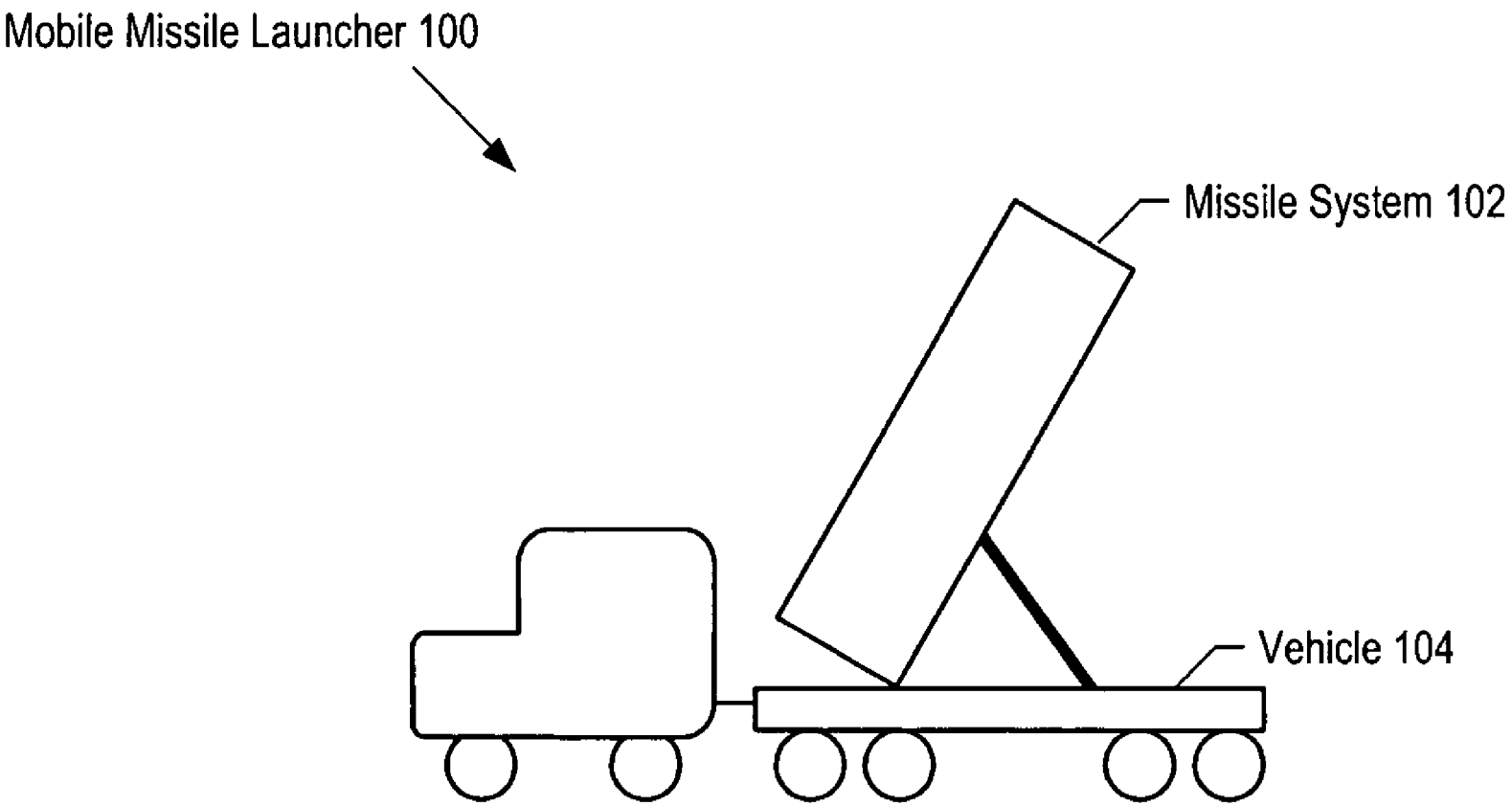
FIG. 1 depicts a block diagram of a mobile missile launcher in accordance with the illustrative embodiment of the present invention.

FIG. 1 depicts a block diagram of mobile missile launcher 100 in accordance with the illustrative embodiment of the present invention. Mobile missile launcher 100 includes missile system 102 and vehicle 104. Although vehicle 104 is a truck, it will be clear to those skilled in the art, after reading this disclosure, how to make and use alternative embodiments of the present invention in which missile system 102 is mounted on another type of vehicle (e.g., a warship, a railroad car, a submarine, a space vehicle, an airplane, a satellite, etc.).

As discussed in the background section, a missile system is subject to shock and vibration prior to missile launch; for example, during shipping and during movement of its launch platform. Therefore, it is desirable to provide shock-absorption between a missile and its container. Shock-absorbers, hereinafter referred to as "snubbers," are typically disposed between a missile and its missile canister in order to attenuate mechanical energy that might be transferred from the missile canister to the missile. It is desirable, however, that these snubbers not interfere with the proper launch of the missile.

Figure 2:
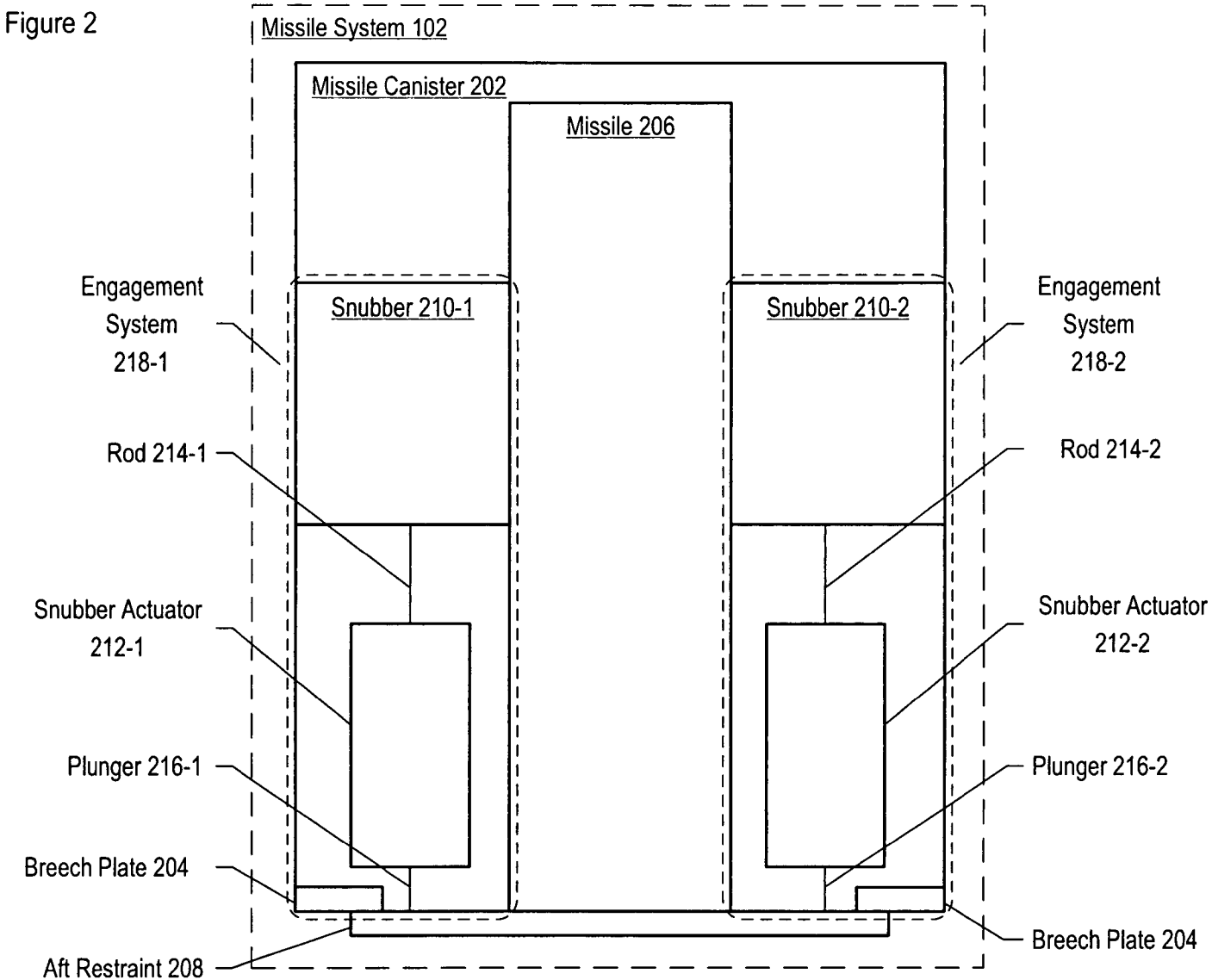
FIG. 2 depicts a block diagram of the salient components of a missile system in accordance with the illustrative embodiment of the present invention.

FIG. 2 depicts a block diagram of the salient components of missile system 102 in accordance with the illustrative embodiment of the present invention. Missile system 102 comprises missile canister 202, breech plate 204, missile 206, aft restraint 208, snubbers 210-1 and 210-2, snubber actuators 212-1 and 212-2, rods 214-1 and 214-2, and plungers 216-1 and 216-2.

Missile canister 202, together with breech plate 204 and aft restraint 208, encloses missile 206, snubbers 210-1 and 210-2, snubber actuators 212-1 and 212-2, rods 214-1 and 214-2, and plungers 216-1 and 216-2, to provide a substantially air-tight environment, in well-known fashion.

Breech plate 204 is a flange which is attached to the aft end of missile canister 202. Breech plate 204 adds to the structural rigidity of missile canister 202 and provides a mounting plate for aft restraint 208. Missile 206, which includes an explosive warhead and a chemical-propellant engine, is attached to aft restraint 208 prior to missile launch. When rigidly attached to breech plate 204 (e.g., by bolts, rivets, etc.), aft restraint 208 restrains missile 206 from moving within missile canister 202. It will be clear to those skilled in the art how to make and use aft restraint 208.

Plungers 216-1 and 216-2, snubber actuators 212-1 and 212-2, rods 214-1 and 214-2, and snubbers 210-1 and 210-2 together compose respective engagement systems 218-1 and 218-2. During the missile loading process, engagement systems 218-1 and 218-2 cause snubbers 210-1 and 210-2 to engage missile 206 and simultaneously place snubber actuators 212-1 and 212-2 into a mechanically-bi-stable state.

The cooperative relationships between the various elements of engagements systems 218-1 and 218-2 are described briefly below and then in further detail in conjunctions with FIGS. 3A, 3B, 4A through 4C, and 5A-5C.

Snubbers 210-1 and 210-2 are shock-absorbing devices that are disposed between missile canister 202 and missile 206. The snubbers are moved from a first position wherein the snubbers are engaged with missile 206 to a second position where they are disengaged from missile 206 by snubber actuators 212-1 and 212-2. In the second position, snubbers 210-1 and 210-2 do not impede egress of missile 206 from canister 202 during missile launch.

Rods 214-1 and 214-2 are rigid rods having sufficient strength to effectively transfer force from snubber actuators 212-1 and 212-2 to snubbers 210-1 and 210-2. Plungers 216-1 and 216-2 are rigid rods having sufficient strength to withstand forces applied to them during missile insertion, storage, transport, and launch. In operation, plungers 216-1 and 216-2 transfer mechanical force from aft restraint 208 to snubber actuators 212-1 and 212-2.

Suitable materials for missile canister 202, breech plate 204, aft restraint 208, rods 214-1 and 214-2, and plungers 216-1 and 216-2 include, without limitation, metal, fiberglass, plastic, graphite, and ceramics.

Although FIG. 2 depicts a missile system comprising two snubbers, it will be clear to those skilled in the art, after reading this specification, how to make and use alternative embodiments of the present invention that comprise any number of snubbers. Furthermore, it will be clear to those skilled in the art, after reading this specification, how to make and use alternative embodiments of the present invention that comprise multiple snubbers that are ganged together and actuated by a single snubber actuator.

The configuration and operation of engagement system 218-2 (which is identical to the configuration and operation of engagement system 218-1) is now described with reference to FIGS. 3A and 3B.

Figures 3A, 3B:
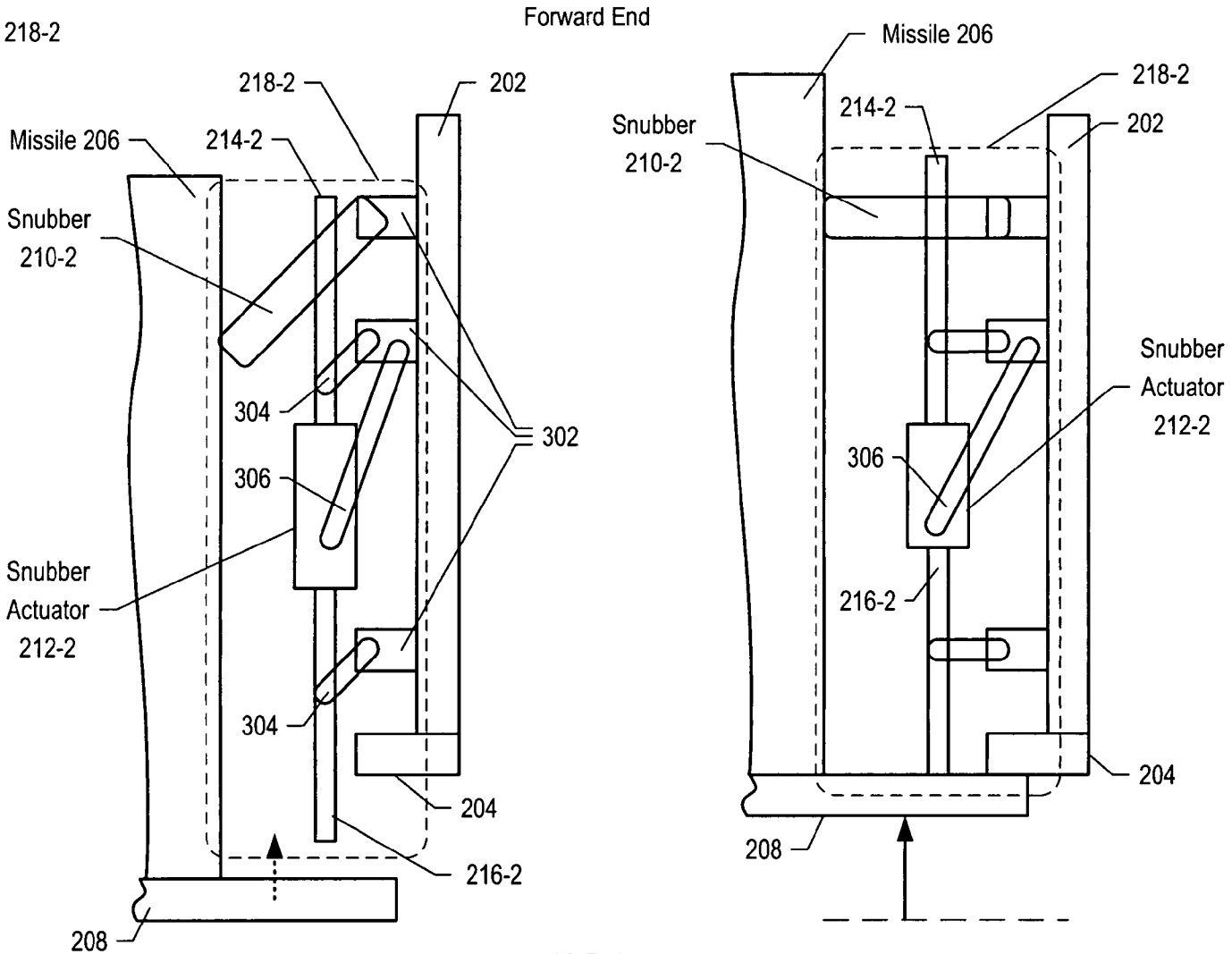
FIG. 3A depicts an engagement system, as a missile is being loaded in a missile canister, according to the illustrative embodiment of the present invention.
FIG. 3B depicts an engagement system, after a missile has been loaded in a missile canister, according to the illustrative embodiment of the present invention.

FIGS. 3A and 3B depict the salient components of engagement system 218-2. FIG. 3A depicts the engagement system as missile 206 is being loaded and FIG. 3B depicts the engagement system after missile loading is complete.

Engagement system 218-2 is mounted to missile canister 202 via standoffs 302 and linkages 304. This arrangement of standoffs and linkages enables the various elements of engagement system 218-2 to move during the missile loading process.

During loading, missile 206 and its attached aft restraint 208 are inserted into the aft end of missile canister 202. As depicted in FIG. 3A, plunger 216-2 extends beyond breech plate 204 (until missile 206 is fully inserted.) As missile 206 is loaded, aft restraint 208 contacts plunger 216-2 and forces plunger 216-2, snubber actuator 212-2, and rod 214-2 toward the forward end of missile canister 202. Linkages 304 enable motion of these components about standoffs 302. As rod 214-2 is forced toward the forward end of missile canister 202, snubber 210-2 engages with missile 206, and a spring in snubber actuator 212-2 compresses. Retainer strap 306 and plunger 216-2 fix the position of snubber actuator 212-2 with respect to snubber 210-2 and aft restraint 208.

As depicted in FIG. 3B, at the completion of the missile loading process:

- aft restraint 208 is in contact with breech plate 204;
- snubber 210-2 is oriented at a 90° angle to the missile canister sidewall and missile 206; and
- snubber actuator 212-2 is compressed and latched in a mechanically-bi-stable state.

Further details concerning the cooperative relationship between snubber 210-2 and snubber actuator 212-2 and further description of the structure of these elements is now presented in conjunction with FIGS. 4A through 4C and FIGS. 5A through 5C.

Snubber 210-2 and snubber actuator 212-2 together form a passive actuator. Snubber actuator 212-2 actuates in a purely-mechanical fashion in response to a physical stimulus, which is motion of missile 206 that exceeds a threshold.

Mechanical actuation of snubber actuator 212-2 is enabled by its mechanically-bi-stable state. As previously described, missile 206 is placed in the mechanically-bi-stable state as it's loaded into missile canister 202. The mechanically-bi-stable state of snubber actuator 212-2 is characterized by two positions: a latched position (depicted in FIG. 5B), and an actuated position (depicted in FIG. 5C). As will be described in more detail below, motion of missile 206 that causes snubber 210-2 to rotate beyond a designed threshold of 10° (an angle indicative of missile launch) causes snubber actuator 212-2 to snap from its engaged position to its actuated position. When snubber actuator 212-2 actuates, it forces snubber 210-2 to rotate completely out of the way of missile 206 as it continues its launch.

Figure 4A:
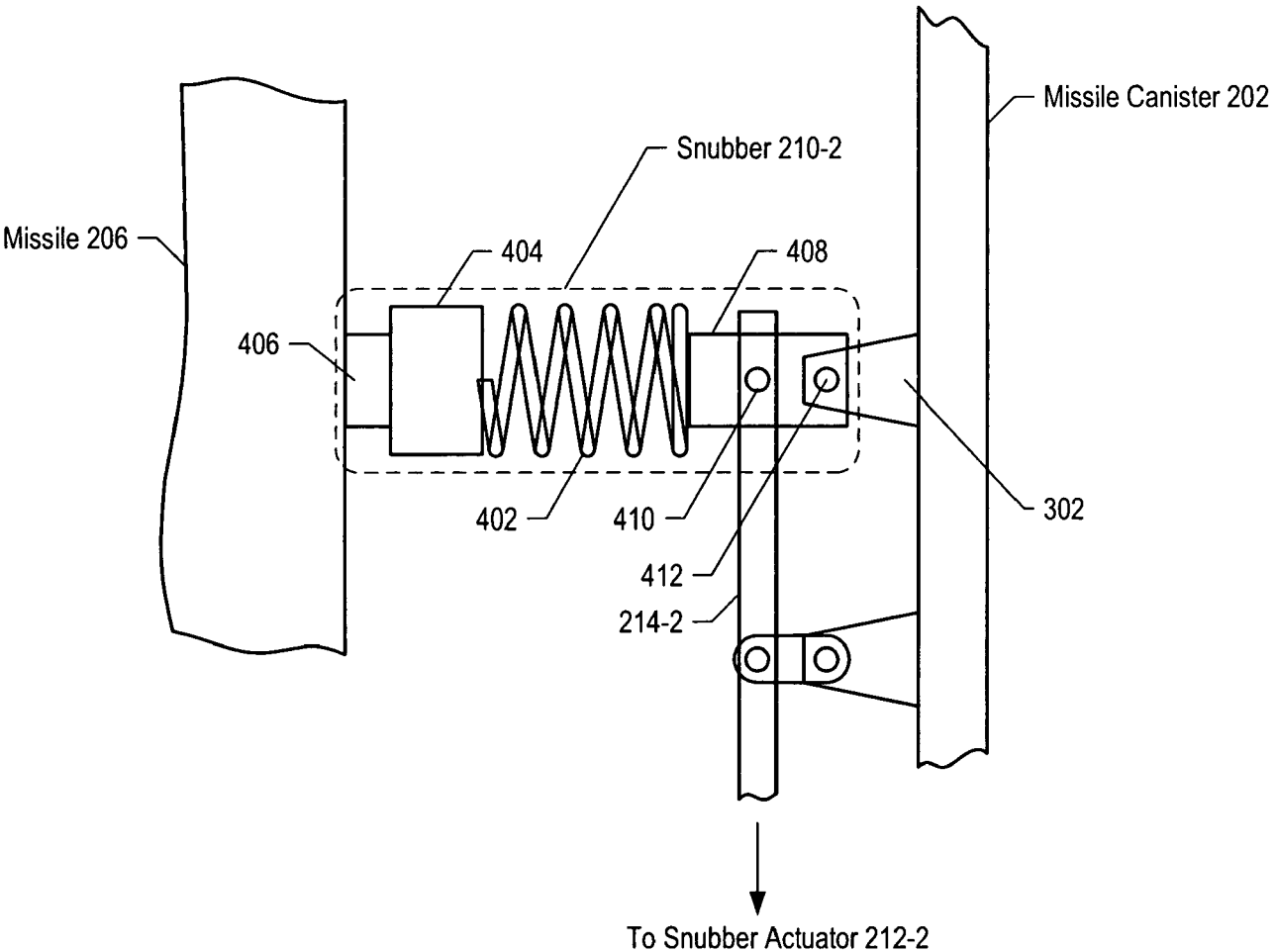
FIG. 4A depicts snubber 210-2 in its engaged position according to the illustrative embodiment of the present invention.
Figure 4B:
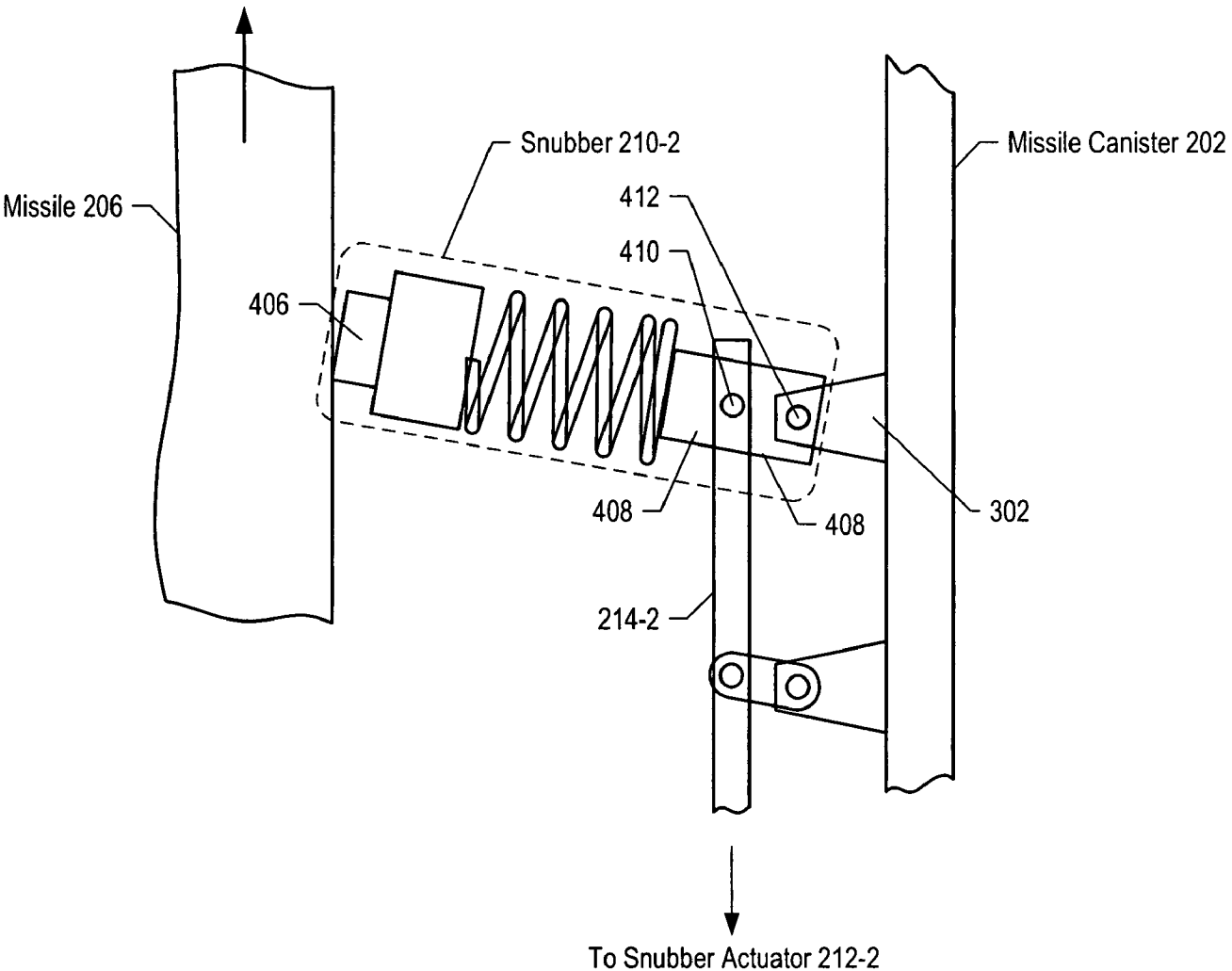
FIG. 4B depicts a snubber, during missile launch, according to the illustrative embodiment of the present invention.
Figure 4C:
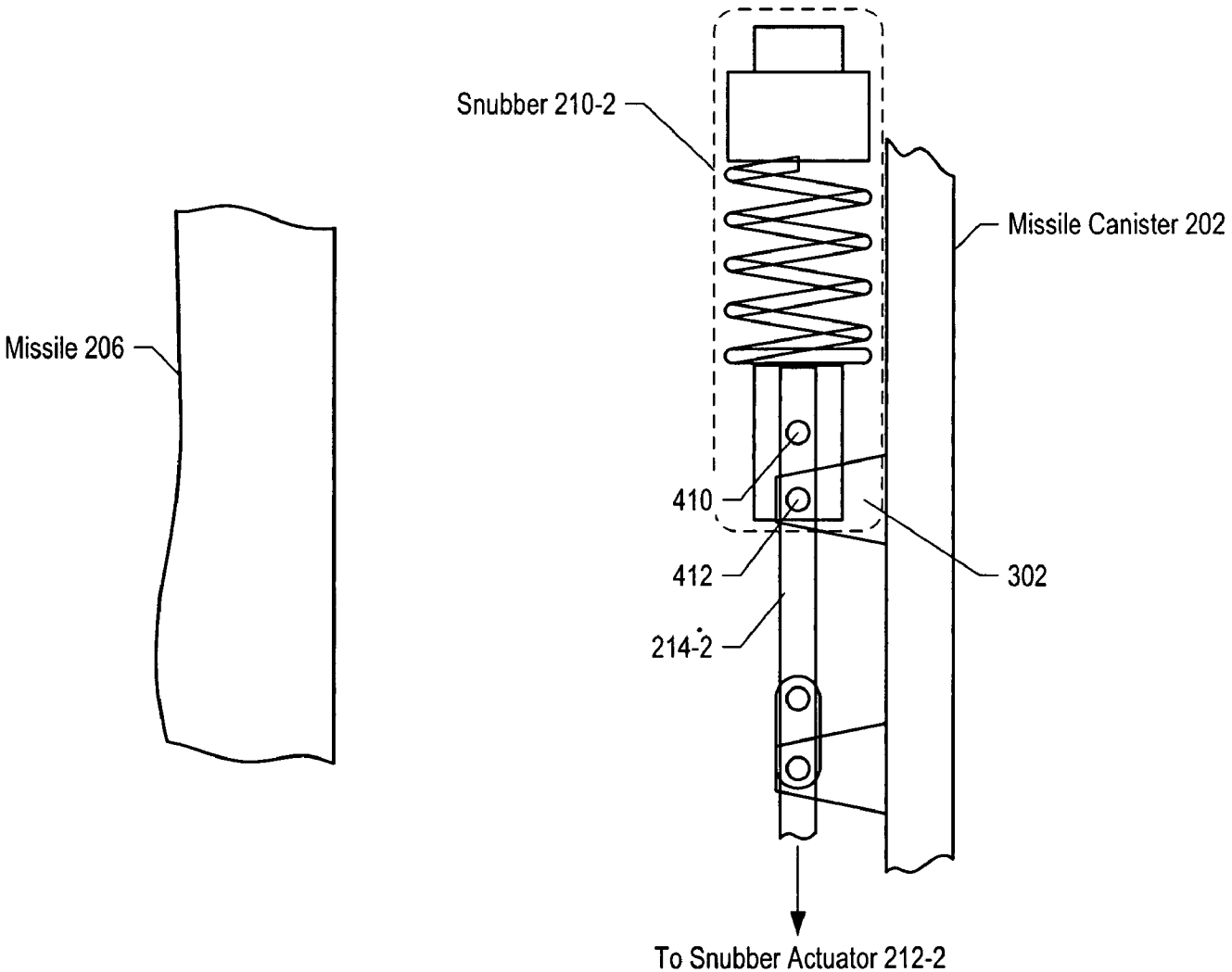
FIG. 4C depicts a snubber in its post-actuation position according to the illustrative embodiment of the present invention.
Figure 5C:
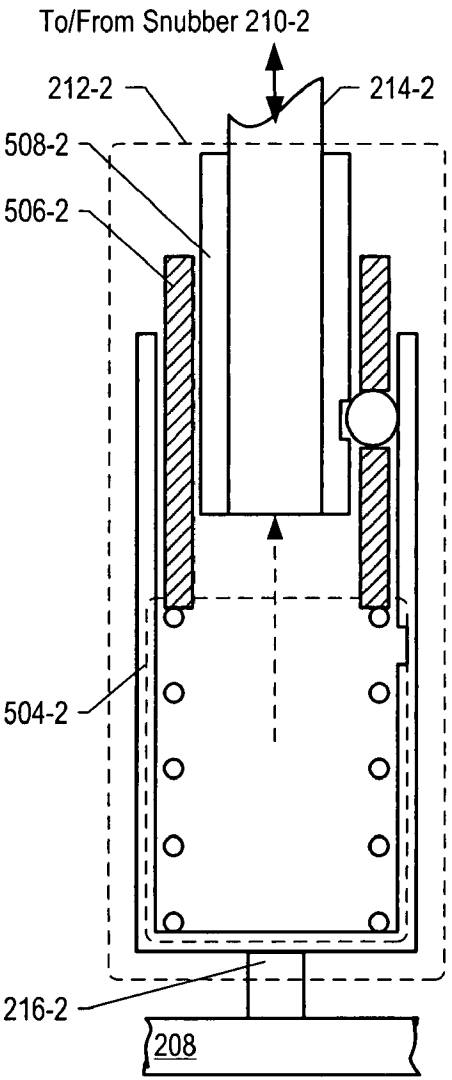
FIG. 5C depicts a snubber actuator in its post-actuated state that corresponds to the position of the snubber in FIG. 4C, according to the illustrative embodiment of the present invention.
Figure 5B:
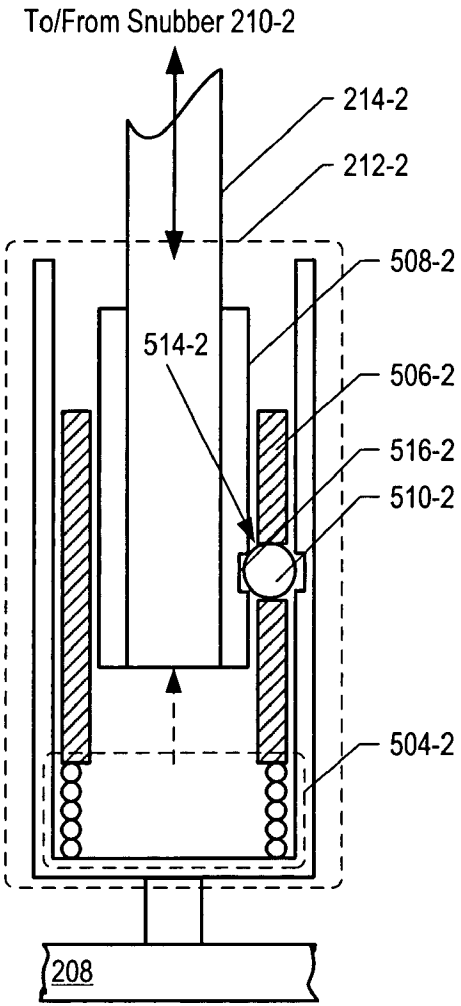
FIG. 5B depicts a snubber actuator in a state during missile launch that corresponds to the position of the snubber in FIG. 4B, according to the illustrative embodiment of the present invention.
Figure 5A:
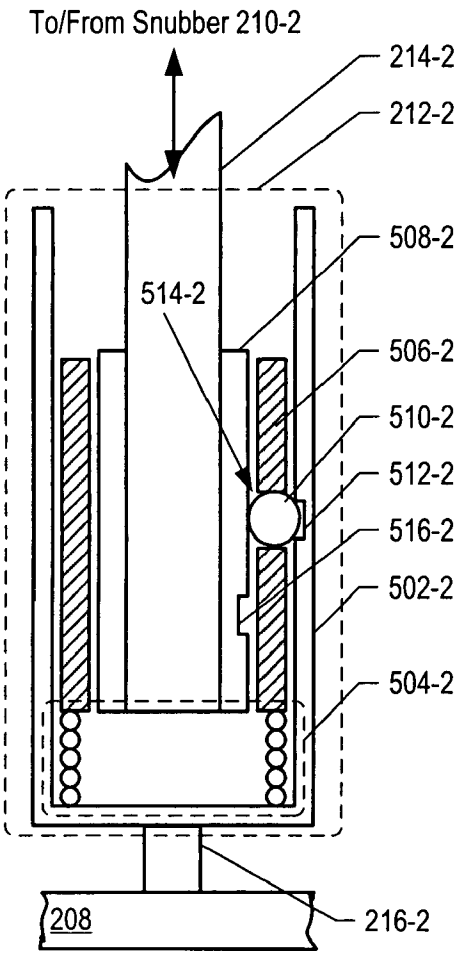
FIG. 5A depicts a snubber actuator in a mechanically-bi-stable state that corresponds to the position of the snubber in FIG. 4A, according to the illustrative embodiment of the present invention.

FIGS. 4A through 4C depict views of snubber 210-2 and FIGS. 5A through 5C depict views of snubber actuator 212-2 at three key moments of a representative launch sequence: (1) initiation of launch; (2) during launch, when the motion of missile 206 has caused snubber 210-2 to rotate and force snubber actuator 212-2 to its "trigger point;" and (3) post-actuation when snubber actuator 212-2 has actuated to force snubber 210-2 to disengage from missile 206 and move to a "cleared" position.

Initiation of Launch

FIG. 4A depicts snubber 210-2 in its engaged position according to the illustrative embodiment of the present invention. At initiation of launch, snubber 210-2 has already been put into its engaged position as described above and with respect to FIGS. 3A and 3B. Prior to missile launch, snubber 210-2 provides shock-absorption for missile system 102, so as to impede the transfer of mechanical energy between missile canister 202 and missile 206. Snubber 210-2 comprises spring 402, head 404, pad 406, and base 408.

Spring 402 is a helical steel spring having sufficient strength to provide suitable shock absorption for missile 206. The resilient nature of spring 402 permits small motions of missile 406, yet spring 402 conveys large motions (such as those associated with missile launch) of missile 406 to base 408. In other words, spring 402 enables snubber 210-2 to passively differentiate between random motions associated with shock and vibration from the motion associated with missile launch.

Base 408 is a metal frame that provides a base to which spring 402 and pad 406 are coupled. Base 408 is attached to rod 214-2 via rotary joint 410, so as link base 408 to snubber actuator 212-2. Rotary joint 412 provides a point of rotation about which snubber 210-2 rotates as a unit.

Head 404 is a metal frame that provides a base to which spring 402 is attached. Head 404 is coupled to rod 214-2 and standoffs 302 via rotary connections 410. Rod 214-2 provides a rigid coupling between snubber 210-2 and snubber actuator 212-2.

Pad 406 is a plastic pad that provides a contact surface for snubber 210-2. Pad 406 is the point at which snubber 210-2 engages missile 206.

Alternative materials for spring 402, head 404, pad 406, and base 408 include without limitation, fiberglass, plastic, graphite, and ceramics.

FIG. 5A depicts snubber actuator 212-2 in a mechanically-bi-stable state that corresponds to the position of snubber 210-2 in FIG. 4A. At initiation of launch, snubber actuator 212-2 has already been placed in a mechanically-bi-stable state as described above and with respect to FIGS. 3A and 3B. Snubber actuator 212-2 comprises fixed sleeve 502-2, spring 504-2, transfer sleeve 506-2, locking sleeve 508-2, and ball 510-2. Fixed sleeve 502-2 includes detent 512-2 and locking sleeve 508-2 includes detent 516-2, both of which are suitable for partially capturing ball 510-2. Transfer sleeve 508-2 includes opening 514-2, which is suitable for capturing ball 510-2 and allowing it to move between detents 514-2 and 516-2.

Fixed sleeve 502-2 is a rigid cylindrical housing whose position in space is fixed by plunger 216-2, aft restraint 208, and retainer strap 306 (not shown for clarity). Fixed sleeve 502-2 has a length and a diameter that is sufficient to accommodate transfer sleeve 506-2 and the motion of transfer sleeve 506-2 during missile launch. When aft restraint 208 is fixed to missile canister 202, fixed sleeve provides a rigid platform against which spring 504-2 is held in compression.

Spring 504-2 is a helical spring that has a size that is sufficient to ensure that the speed of actuation of snubber actuator 212-2 is sufficient to clear snubber 210-2 from the path of missile 206 during missile launch. Compressed spring 504-2 provides the potential energy required for mechanical-bi-stability of snubber actuator 212-2, as well as the force required to drive snubber 210-2 into its cleared position when snubber actuator 212-2 is actuated.

Transfer sleeve 506-2 is a rigid cylinder that has a length and a diameter that is sufficient to accommodate locking sleeve 508-2 and its motion during missile launch. Transfer sleeve includes opening 514-2, which holds ball 510-2. Transfer sleeve 506-2, ball 510-2, detent 512-2, and detent 514-2 together compose a latching mechanism for snubber actuator 212-2.

Ball 510-2 is a rigid sphere with a diameter that is slightly smaller than opening 514-2. At initiation of launch, ball 510-2 is captured by opening 514-2 and detent 512-2, such that transfer sleeve 506-2 and fixed sleeve 502-2 are locked together. When transfer sleeve 506-2 and fixed sleeve 502-2 are locked together, spring 504-2 is kept in its compressed state.

Locking sleeve 508-2 is a rigid cylinder that has a length and a diameter that is sufficient to accommodate rod 214-2. Locking sleeve 508-2 is rigidly fixed to rod 214-2; therefore, locking sleeve 508-2 is coupled to snubber 210-2. Because locking sleeve 508-2 is operationally-coupled to snubber 210-2, rotational motion of snubber 210-2 about rotary joint 412 causes linear motion of locking sleeve 508-2 within transfer sleeve 506-2.

Trigger Point

FIG. 4B depicts snubber 210-2 and FIG. 5B depicts snubber actuator 212-2 during missile launch. Snubber 210-2 is depicted at a point wherein missile 206 has begun its travel and snubber 210-2 has rotated 10° about rotary joint 412, i.e., the "trigger point" for the illustrative embodiment. It will be clear to those skilled in the art, after reading this specification, how to make and use alternative embodiments of the present invention wherein the trigger point is other than 10° of rotation about a rotary joint.

The configuration of rod 214-2, rotary joint 410, rotary joint 412 and standoff 302 results in a conversion of rotary motion of snubber 210-2 about rotary joint 412 into a linear motion of rod 214-2. Since they are physically-coupled, linear motion of rod 214-2 is conveyed to locking sleeve 508-2 as depicted in FIG. 5B.

The trigger point of snubber actuator 212-2 is determined by the point at which detent 516-2 aligns with ball 510-2. At the trigger point: (1) ball 510-2 releases from detent 512-2, which therefore releases transfer sleeve 506-2 from fixed sleeve 502-2; and (2) ball 510-2 is captured by opening 514-2 and detent 516-2, thereby locking transfer sleeve 506-2 and locking sleeve 508-2 together. As a result, the restraining force that keeps spring 504-2 compressed is removed and spring 504-2 is free to release and drive transfer sleeve 506-2 (and locking sleeve 508-2) toward snubber 210-2. In other words, mechanically-bi-stable snubber actuator 212-2 is free to snap to its actuated position as depicted in FIG. 5C.

Post-Actuation

FIG. 4C depicts snubber 210-2 and FIG. 5C depicts snubber actuator 212-2 post-actuation.

Once snubber 210-2 reaches the trigger point, its configuration becomes governed by the state of snubber actuator 212-2. As depicted in FIG. 5C, spring 504-2 has been released and has driven transfer sleeve 506-2 and locking sleeve 508-2 (and therefore, rod 214-2) toward snubber 210-2. Aft restraint 208 and plunger 216-2 ensure that the energy previously stored in spring 504-2 is manifested as a force applied to transfer sleeve 508-2.

Turning now to FIG. 4C, as rod 214-2 is driven toward snubber 210-2, rod 214-2 forces snubber 210-2 to continue rotating about rotary joint 412. The design of snubber 210-2, standoff 302, snubber actuator 212-2, and rod 214-2 ensure that snubber 210-2 rotates into its cleared position, i.e., 90° from its engaged position. The cleared position of snubber 210-2 is a position that does not hinder egress of missile 206 from missile canister 202. It will be clear to those skilled in the art, after reading this specification, how to make and use alternative embodiments of the present invention wherein snubber 210-2 has a cleared position that is other than 90° from its engaged position.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising:

a missile canister;

a first snubber for restricting a first motion of a missile relative to the missile canister, wherein the first snubber has a first position and a second position; and a passive actuator, wherein the passive actuator moves the first snubber from the first position to the second position when actuated, and wherein the passive actuator is actuated by a second motion of the missile when the second motion exceeds a threshold.

2. The apparatus of claim 1 further comprising the missile.

3. The apparatus of claim 1 wherein the actuator has a mechanically-bi-stable state.

4. The apparatus of claim 3 wherein the mechanically-bi-stable state is induced by the insertion of the missile into the missile canister.

5. The apparatus of claim 1 wherein the first snubber comprises a resilient member for absorbing energy associated with longitudinal and transverse motion of the missile relative to the missile canister.

6. The apparatus of claim 1 further comprising a second snubber, wherein the second snubber has a third position and a fourth position, and wherein the passive actuator moves the second snubber from the third position to the fourth position when actuated.

7. The apparatus of claim 1 wherein the actuator comprises a spring and a latch for holding the spring in a compressed state.

8. An apparatus for providing shock-absorption for a missile contained in a missile canister, wherein the apparatus comprises:

a snubber; and a passive actuator, wherein the passive actuator has a mechanically bi-stable state and a mechanically stable state, and wherein a motion of the missile that exceeds a threshold induces the passive actuator to switch from the mechanically bi-stable state to the mechanically stable state;

wherein the snubber and the passive actuator are mechanically coupled, and wherein the snubber is engaged with the missile when the passive actuator is in the mechanically bi-stable state, and further wherein the snubber is disengaged from the missile when the passive actuator is in the mechanically stable state.

9. The apparatus of claim 8 wherein the passive actuator comprises:

a transfer sleeve that contains a ball;

a fixed sleeve having a first detent, wherein the first detent partially captures the ball when the passive actuator is in the mechanically bi-stable state; and a locking sleeve having a second detent, wherein the locking sleeve and the snubber are mechanically coupled, and wherein the motion of the missile enables the second detent to partially capture the ball and enable the release of the ball from the first detent;

wherein the transfer sleeve is substantially immovable with respect to the fixed sleeve when the ball is partially captured by the first detent; and wherein the transfer sleeve is substantially immovable with respect to the locking sleeve when the ball is partially captured by the second detent.

10. The apparatus of claim 8 wherein the snubber comprises a spring having a first longitudinal axis, and wherein the spring is resilient along a first direction and a second direction, and wherein the first direction is aligned with the first longitudinal axis and the second direction is unaligned with the first longitudinal axis, and further wherein the spring enables the snubber to absorb mechanical energy directed along each of the first direction and the second direction when the snubber and the missile are engaged.

11. The apparatus of claim 10 wherein the missile has a second longitudinal axis, and wherein the first longitudinal axis and the second longitudinal axis are substantially orthogonal when the snubber and the missile are engaged.

12. The apparatus of claim 11 wherein the first longitudinal axis and the second longitudinal axis are substantially parallel when the snubber and the missile are disengaged.

13. The apparatus of claim 12 further comprising a rigid rod, wherein the snubber and the passive actuator are mechanically coupled through via the rigid rod, and wherein the rigid rod enables the passive actuator to move the snubber from a first position in which the device and the missile are engaged to a second position in which the snubber and the missile are disengaged.

14. An apparatus comprising:

a missile canister;

a snubber for restricting a first motion of a missile relative to the missile canister; and a passive actuator comprising a spring and a latching mechanism, wherein the passive actuator and the snubber are mechanically coupled, and wherein the latching mechanism holds the spring in a compressed state when a second motion of the missile relative to the missile canister is below a threshold, and further wherein the latching mechanism releases the spring from the compressed state when the second motion exceeds the threshold;

wherein the snubber and the missile are engaged when the spring is in the compressed state; and wherein the release of the spring from the compressed state induces the snubber to disengage the missile.

15. The apparatus of claim 14, wherein the snubber is in a first position when the spring is in the compressed state, and wherein the snubber is in a second position when the spring is in an uncompressed state, and further wherein the spring induces the snubber to move from the first position to the second position at a faster rate than the motion of the missile when the spring is released.

16. The apparatus of claim 14 wherein the latching mechanism comprises;

a transfer sleeve that contains a ball;

a fixed sleeve having a first detent, wherein the first detent partially captures the ball when the passive actuator is in the mechanically bi-stable state; and a locking sleeve having a second detent, wherein the locking sleeve and the snubber are mechanically coupled, and wherein the motion of the missile enables the second detent to partially capture the ball and enable the release of the ball from the first detent;

wherein the transfer sleeve is substantially immovable with respect to the fixed sleeve when the ball is partially captured by the first detent; and wherein the transfer sleeve is substantially immovable with respect to the locking sleeve when the ball is partially captured by the second detent.

17. The apparatus of claim 16 wherein the spring is compressed between the transfer sleeve and a first surface of the fixed sleeve when the ball is partially captured by the first detent, and wherein the spring drives the transfer sleeve away from the first surface when the ball is released from the first detent.

18. The apparatus of claim 14, wherein the snubber enables three-dimensional motion of the missile with respect to the missile canister when the snubber and the missile are engaged.

* * * * *

UNITED STATES PATENT AND TRADEMARK OFFICE

CERTIFICATE OF CORRECTION

PATENT NO. : 7,624,669 B2
APPLICATION NO. : 11/120419
DATED : December 1, 2009
INVENTOR(S) : Buddy R. Paul It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 486 days.

Signed and Sealed this

Twenty-sixth Day of October, 2010

David J. Kappos

David J. Kappos
*Director of the United States Patent and Trademark Office*